US007102289B2

(12) United States Patent
Machida

(10) Patent No.: US 7,102,289 B2
(45) Date of Patent: Sep. 5, 2006

(54) DISCHARGE TUBE

(75) Inventor: Kazuhiko Machida, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 0 days.

(21) Appl. No.: 10/957,035

(22) Filed: Oct. 1, 2004

(65) Prior Publication Data

US 2005/0073231 A1 Apr. 7, 2005

(30) Foreign Application Priority Data

Oct. 6, 2003 (JP) ..... 2003-347031

(51) Int. Cl.
*H01J 61/54* (2006.01)

(52) U.S. Cl. ..... 313/602; 313/601; 313/603

(58) Field of Classification Search ..... 313/601–603, 313/231.11, 233; 315/330
See application file for complete search history.

(56) References Cited

U.S. PATENT DOCUMENTS 6,025,672 A * 2/2000 Machida ..... 313/231.11
6,617,770 B1 * 9/2003 Machida ..... 313/231.01
6,617,804 B1 * 9/2003 Machida ..... 315/209 M

FOREIGN PATENT DOCUMENTS

JP 10-335042 12/1998

* cited by examiner

*Primary Examiner*—Joseph Williams
*Assistant Examiner*—Hana Sanei
(74) *Attorney, Agent, or Firm*—Ladas & Parry LLP

(57) ABSTRACT

A discharge tube is disclosed that includes: an airtight tube having first and second end surfaces each including a metallized surface; first and second discharge electrodes joined to the respective metallized surfaces; and multiple trigger lines formed on the inner wall surface of the airtight tube to extend along the axial directions of the airtight tube. The first and second discharge electrodes are joined to the metallized surfaces so that a discharge gap is formed between the first and second discharge electrodes and the airtight tube is hermetically sealed. The trigger lines include one or more first trigger lines connected to the metallized surfaces and multiple second trigger lines isolated from the metallized surfaces. The second trigger lines are formed at equal intervals on the inner wall surface of the airtight tube and each first trigger line is formed between a corresponding pair of the second trigger lines.

10 Claims, 15 Drawing Sheets

10A(1A)

DISCHARGE TUBE

BACKGROUND OF THE INVENTION

1. Field of the Invention

The present invention relates generally to discharge tubes, and more particularly to a discharge tube that causes discharge to repeatedly occur between the discharge surface of an upper discharge electrode end and the discharge surface of a lower discharge electrode end, the discharge surfaces opposing each other at the center inside an airtight tube.

2. Description of the Related Art

For instance, Japanese Laid-Open Patent Application No. 10-335042 discloses a switching discharge tube (hereinafter, simply referred to as "discharge tube") used in lighting circuits for an HID (High Intensity Discharge) lamp for vehicles, projector lamp, and a back lamp for rear-projection TVs. FIGS. 1 through 3 show a first conventional discharge tube 100A.

Referring to FIG. 1, the discharge tube 100A includes an airtight tube 10D, an upper discharge electrode 22, and a lower discharge electrode 24. The airtight tube 10D has a cylindrical shape. The upper discharge electrode 22 and the lower discharge electrode 24 are joined to the upper-end opening and the lower-end opening, respectively, of the airtight tube 10D.

Disk-like lid bodies 26 and 28 are formed integrally with the upper discharge electrode 22 and the lower discharge electrode 24, respectively. A metallized surface 40 is formed at each of the upper-end opening and the lower-end opening of the airtight tube 10D. Accordingly, the upper discharge electrode 22 and the lower discharge electrode 24 are joined to the airtight tube 10D by brazing the lid bodies 26 and 28 integrated with the upper and lower discharge electrodes 22 and 24, respectively, to the metallized surfaces 40 formed at the upper-end and lower-end openings of the airtight tube 10D. Referring to FIG. 3, lead wires 12 and 14 are connected to the lid bodies 26 and 28, respectively, so that the lid bodies 26 and 28 are connected to external circuits through the lead wires 12 and 14.

The upper discharge electrode 22 projects from the lid body 26 toward the center position of the airtight tube 10D. The end portion of the upper discharge electrode 22 is shaped like a cylinder of a small diameter. A discharge surface 23 is formed on the small-diameter cylindrical end portion of the upper discharge electrode 22 (hereinafter referred to as "upper discharge surface 23"). The upper discharge surface 23 includes a recess 27 for causing discharge to occur in a stabilized manner.

The lower discharge electrode 24 is structured in the same manner. The end portion of the lower discharge electrode 24 is shaped like a cylinder of a small diameter. A discharge surface 25 is formed on the small-diameter cylindrical end portion of the lower discharge electrode 24 (hereinafter referred to as "lower discharge surface 25"). The lower discharge surface 25 also includes the recess 27 for causing discharge to occur in a stabilized manner. In the discharge tube 100A, discharges occur in the space between the upper discharge surface 23 and the lower discharge surface 25. This space is hereinafter referred to as a "discharge gap 29."

Referring to FIGS. 1 and 2, in the discharge tube 100A of the above-described structure, for instance, eight main discharge trigger wires 30 are formed along the axial directions of the airtight tube 10D (or the Y1 and Y2 directions of FIGS. 1 and 2) at equal intervals (with the same pitch W) on the inner sidewall of the airtight tube 10D. Each main discharge trigger wire 30 is spaced from the metallized surfaces 40 so as to be electrically isolated from the metallized surfaces 40.

FIGS. 4 and 5 are diagrams showing a second conventional discharge tube 100B. In FIGS. 4 and 5, the same elements as those of FIGS. 1 through 3 are referred to by the same numerals, and a description thereof is omitted.

According to the second conventional discharge tube 100B, two sub discharge trigger wires 20 as well as the eight main discharge trigger wires 30 are formed on the inner sidewall of an airtight tube 10E. Each sub discharge trigger wire 20 is formed at a center position of the eight main discharge trigger wires 30. That is, four of the main trigger wires 30 are provided in each of the two spaces between the paired sub discharge trigger wires 20.

Like the main discharge trigger wires 30, the sub discharge trigger wires 20 are formed along the axial directions of the airtight tube 10E (or the Y1 and Y2 directions of FIGS. 4 and 5). The upper or lower end of each sub discharge trigger wire 20 is electrically connected to the metallized surface 40 formed on the corresponding upper-end or lower-end surface of the airtight tube 10E.

Conventionally, the sub discharge trigger wires 20 and the main discharge trigger wires 30 are also formed along the axial directions of the airtight tube 10E (or the Y1 and Y2 directions of FIGS. 4 and 5) at equal intervals (with the same pitch W) as shown in FIG. 5. That is, when the distance (interval) between each adjacent two of the main discharge trigger wires 30 is W, the distance (interval) between each sub discharge trigger wire 20 and each of its adjacent main discharge wires 30 is also W.

FIG. 6 is a graph showing the results of a discharge (service) life test conducted to obtain changes over time in the discharge starting voltage of an initial discharge (hereinafter referred to as "initial discharge starting voltage $FV_s$") and the mean discharge voltage of second and subsequent discharges (hereinafter referred to as "mean discharge voltage $V_{s\ MEAN}$") in the first conventional discharge tube 100A of the above-described configuration. In FIG. 6, the horizontal axis indicates the cumulative number of discharges (×10,000), and the vertical axis indicates discharge operation voltage (V).

In this test, the initial discharge starting voltage $FV_s$ and the mean discharge voltage $V_{s\ MEAN}$ at the time of causing the discharge tube 100A to perform discharging after the discharge tube 100A was left in a completely dark place at −40° C. for a predetermined period of time were studied at each predetermined point. Specific test conditions are as follows:

(a) Operation Interval: a second of operation is followed by four seconds of quiescence (hereinafter, this is referred to as "one test cycle"). One hundred discharges are caused to occur in this one test cycle (five seconds), thus resulting in a discharge frequency of 100 Hz;

(b) Measurement Method: the discharge tube 100A is left in an environment of −40° C., and the test cycle is repeated until the cumulative number of discharges reaches a specified measurement number. When the cumulative number of discharge operations reaches each specified measurement number, the initial discharge starting voltage $FV_s$ and the mean discharge voltage $V_{s\ MEAN}$ are measured and calculated.

Specifically, in the case of measuring data at a specified measurement number of 20,000, the test cycle is stopped when the number of times the test cycle is repeated reaches 200, and the discharge tube 100A is left as it is for an hour. Thereafter, the discharge tube 100A is caused to operate for one test cycle, and the initial discharge starting voltage $FV_s$ and the mean discharge voltage $V_{s\ MEAN}$ are measured and calculated. When this measurement operation is completed, the test cycle is started, and is repeated until the next specified measurement number (for instance, 40,000). This operation is repeatedly performed until a specified measurement number of 2,000,000; and (c) Power Supply Circuit for Test: a relaxation oscillator circuit including a capacitor and a coil is employed. In practice, a capacitor of 120 nF (50–150 nF) and a coil of 0.1 μH (0.1–5.0 μH) were employed. According to this relaxation oscillator circuit, when an electric charge is stored in the capacitor, a discharge tube connected thereto performs discharging so as to cause the electric charge to flow to ground. The capacitor, which has lost the electric charge, starts recharging, and when the electric charge is re-stored, the capacitor again discharges. This discharging is repeated in an operation period of one second. The cumulative number of times this discharging operation is repeated corresponds to the cumulative number of discharges of the discharge life test.

The discharge life test is conducted based on the above-described conditions. This discharge life test, which is conducted in a completely dark place in an environment of −40° C., is the severest one of the discharge life tests. This is because there is no effect of thermoelectrons in the environment of −40° C., nor is there any effect of photoelectrons in the completely dark place, thus making it difficult for discharging to occur. A brief description is given below of the effect of photoelectrons and the effect of thermoelectrons.

The effect of photoelectrons refers to the effect that the discharge characteristic of a discharge tube is made faster by photoelectrons. That is, photoelectrons are constantly emitted from the light source of, for instance, an illuminator, so that sufficient photoelectrons have also penetrated into the discharge tube in a light environment. These photoelectrons have the effect of exciting gas sealed in the discharge tube into an easily dischargeable state. Accordingly, the discharge tube placed in a light environment is in a stabilized and easily dischargeable state, thus causing a decrease in the initial discharge start voltage $FV_s$. On the other hand, in a dark place, these photoelectrons do not exist, so that the discharge tube is unstable and it is difficult for discharging to occur, thus causing an increase in the initial discharge start voltage $FV_s$.

The effect of thermoelectrons refers to the effect that the discharge characteristic of a discharge tube is made faster by thermoelectrons. That is, with an increase in temperature, an electron in the outermost shell of an atom becomes more likely to be emitted from the orbit of the outermost shell. Accordingly, the number of thermoelectrons generated also increases in the discharge tube as temperature increases. Therefore, the discharge tube is in a stabilized and easily dischargeable state in a high-temperature environment, thus causing a decrease in the initial discharge start voltage $FV_s$. On the other hand, in a low-temperature environment, the number of thermoelectrons generated is reduced, so that the discharge tube is unstable and it is difficult for discharging to occur, thus causing an increase in the initial discharge start voltage $FV_s$.

For the above-described reasons, the environment of −40° C. and complete darkness (hereinafter referred to as "dark cold environment") is a harsh environment where it is difficult for the discharge tube 100A to cause discharging to occur. On the other hand, if a desired discharge characteristic can be obtained in this dark cold environment, a good $FV_s$ characteristic may be obtained in any environment.

Referring to FIG. 6 in view of the above-described matter, it is understood that in the discharge tube 100A, the initial discharge start voltage $FV_s$ increases as the cumulative number of discharges increases. This is because the discharge-inducing effects of thermoelectrons and photoelectrons on the discharge tube 100A completely disappear in the complete dark cold environment since the discharge tube 100A includes no sub discharge trigger wires contacting the metallized surfaces 40.

Thus, the discharge tube 100A has a problem in that the occurrence of surface corona discharge is delayed so as to reduce the response speed of the initial discharge start voltage $FV_s$. Further, the initial discharge start voltage $FV_s$ increases with an increase in the cumulative number of discharges. In particular, the initial discharge start voltage $FV_s$ exceeds 1000 V around when the cumulative number of discharges exceeds 800,000, thus causing a problem in that the discharge life of the discharge tube 100A is reduced.

Meanwhile, FIG. 7 is a graph showing test results for the second conventional discharge tube 100B at the time of conducting the same discharge life test as described above. Test conditions and environment in this test are the same as those for the above-described discharge tube 100A.

FIG. 7 shows that in the discharge tube 100B, the initial discharge start voltage $FV_s$ fluctuates greatly as the cumulative number of discharges increases. The discharge tube 100B includes the sub discharge trigger wires 20 electrically connected to the metallized surfaces 40. Accordingly, even in the completely dark cold environment, induction of surface corona discharge is likely to occur in the discharge tube 100B compared with the discharge tube 100A with no sub discharge trigger wires 20. However, since the main discharge trigger wires 30 in the center are disposed at an irregular interval (or too wide an interval), transfer to main discharge is likely to be delayed, thus causing the initial discharge start voltage $FV_s$ to fluctuate as in the test results.

Specifically, referring to FIG. 5, the sub discharge trigger wires 20 are disposed between a group of the main discharge trigger wires 30 indicated by arrow A1 and a group of the main discharge trigger wires 30 indicated by arrow A2. Accordingly, the interval between the main discharge trigger wire 30 indicated by arrow MT1 of one group and the main discharge trigger wire 30 indicated by arrow MT2 of the other group is 2×W. Thus, the main discharge trigger wires 30 are disposed at an irregular interval in some parts, causing the initial discharge start voltage $FV_s$ to fluctuate.

Thus, fluctuations in the initial discharge start voltage $FV_s$ cause the operation of a ballast circuit for lighting an HID lamp using the discharge tube 100B to be unstable. However, compared with the $FV_s$ characteristic of the discharge tube 100A, the initial discharge start voltage $FV_s$ is prevented from rising excessively in the discharge tube 100B.

SUMMARY OF THE INVENTION

Accordingly, it is a general object of the present invention to provide a discharge tube in which the above-described disadvantages are eliminated.

A more specific object of the present invention is to provide a discharge tube with a longer useful service life and a capability to generate stable discharging.

The above objects of the present invention are achieved by a discharge tube, including: an airtight tube formed of an insulator, the airtight tube having first and second end surfaces each having a metallized surface formed thereon; a first discharge electrode joined to the metallized surface formed on the first end surface of the airtight tube; a second discharge electrode joined to the metallized surface formed on the second end surface of the airtight tube; and a plurality of trigger lines formed on an inner wall surface of the airtight tube so as to extend in axial directions of the airtight tube, wherein: the first and second discharge electrodes are joined to the metallized surfaces so that a discharge gap is formed between the first and second discharge electrodes and the airtight tube is hermetically sealed; the trigger lines include one or more first trigger lines connected to the metallized surfaces and a plurality of second trigger lines isolated from the metallized surfaces; and the second trigger lines are formed at equal intervals on the inner wall surface of the airtight tube and each of the one or more first trigger lines is formed between a corresponding pair of adjacent ones of the second trigger lines.

The above objects of the present invention are also achieved by a discharge tube, including: an airtight tube formed of an insulator, the airtight tube having first and second end surfaces each having a metallized surface formed thereon; a first discharge electrode joined to the metallized surface formed on the first end surface of the airtight tube; a second discharge electrode joined to the metallized surface formed on the second end surface of the airtight tube; and a plurality of trigger lines formed on an inner wall surface of the airtight tube so as to extend in axial directions of the airtight tube, wherein: the first and second discharge electrodes are joined to the metallized surfaces so that a discharge gap is formed between the first and second discharge electrodes and the airtight tube is hermetically sealed; the trigger lines include one or more first trigger lines connected to the metallized surfaces, a plurality of second trigger lines isolated from the metallized surfaces, and one or more third trigger lines isolated from the metallized surfaces; and the second trigger lines are formed at equal intervals on the inner wall surface of the airtight tube and each of the one or more third trigger lines is formed between a corresponding pair of adjacent ones of the second trigger lines.

The above objects of the present invention are also achieved by a discharge tube, including: an airtight tube having first and second end surfaces each including a metallized surface; first and second discharge electrodes joined to the metallized surfaces of the first and second end surfaces, respectively, of the airtight tube so that a discharge gap is formed between the first and second discharge electrodes and the airtight tube is hermetically sealed; and a plurality of trigger lines arranged on an inner wall surface of the airtight tube so that each trigger line extends along an axis of the airtight tube, the trigger lines being spaced at first and second intervals in first and second parts, respectively, of the inner wall surface, the first and second intervals being different from each other.

According to the present invention, in a discharge tube, trigger lines, arranged with a first part where the trigger lines are arranged at a first interval and a second part where the trigger lines are arranged at a second interval different from the first interval, are formed in the arrangement. This configuration enables the discharge tube to have a longer useful service life and to stabilize discharge potentials repeatedly generated in the discharge tube.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Next, a description is given, with reference to the accompanying drawings, of embodiments of the present invention.

Figure 1:
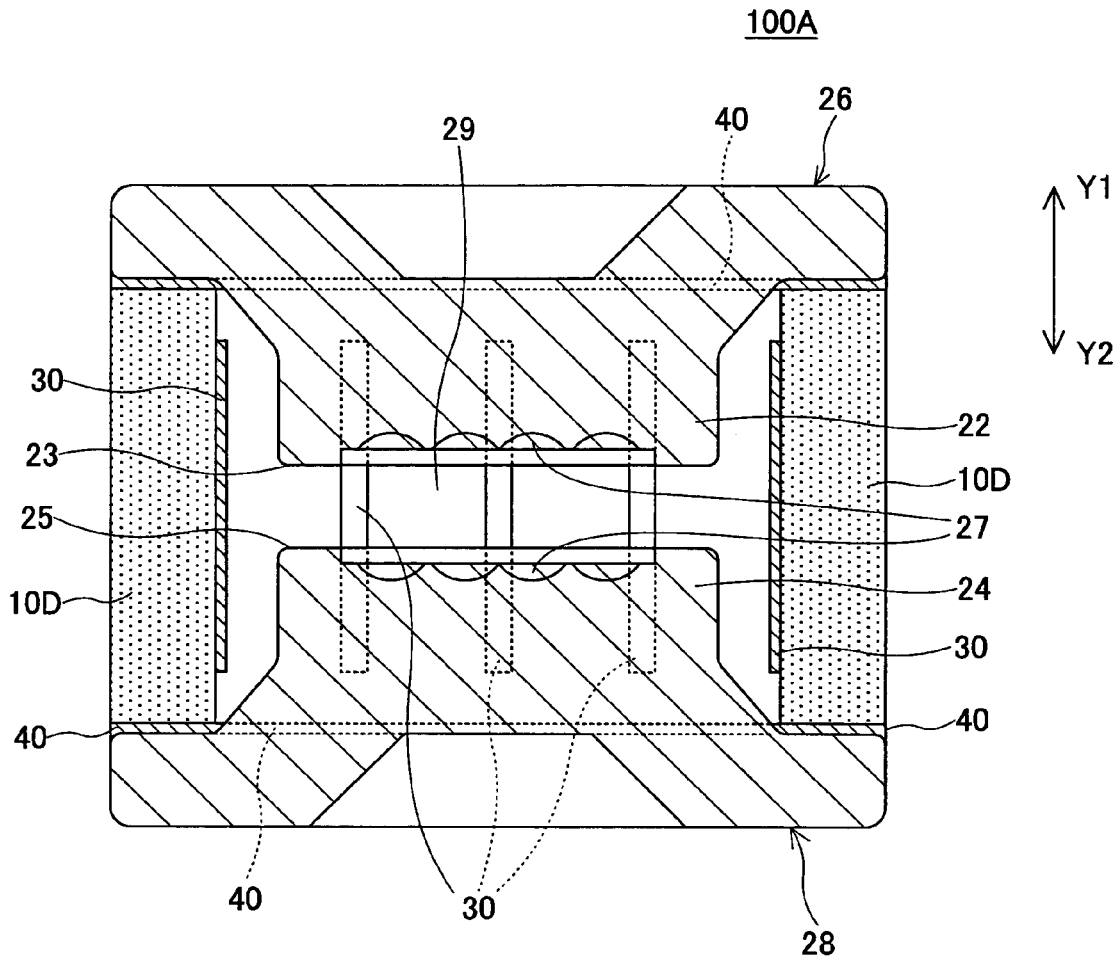
FIG.1 PRIOR ART
FIG. 1 is a cross-sectional view of a first conventional discharge tube.
Figure 2:
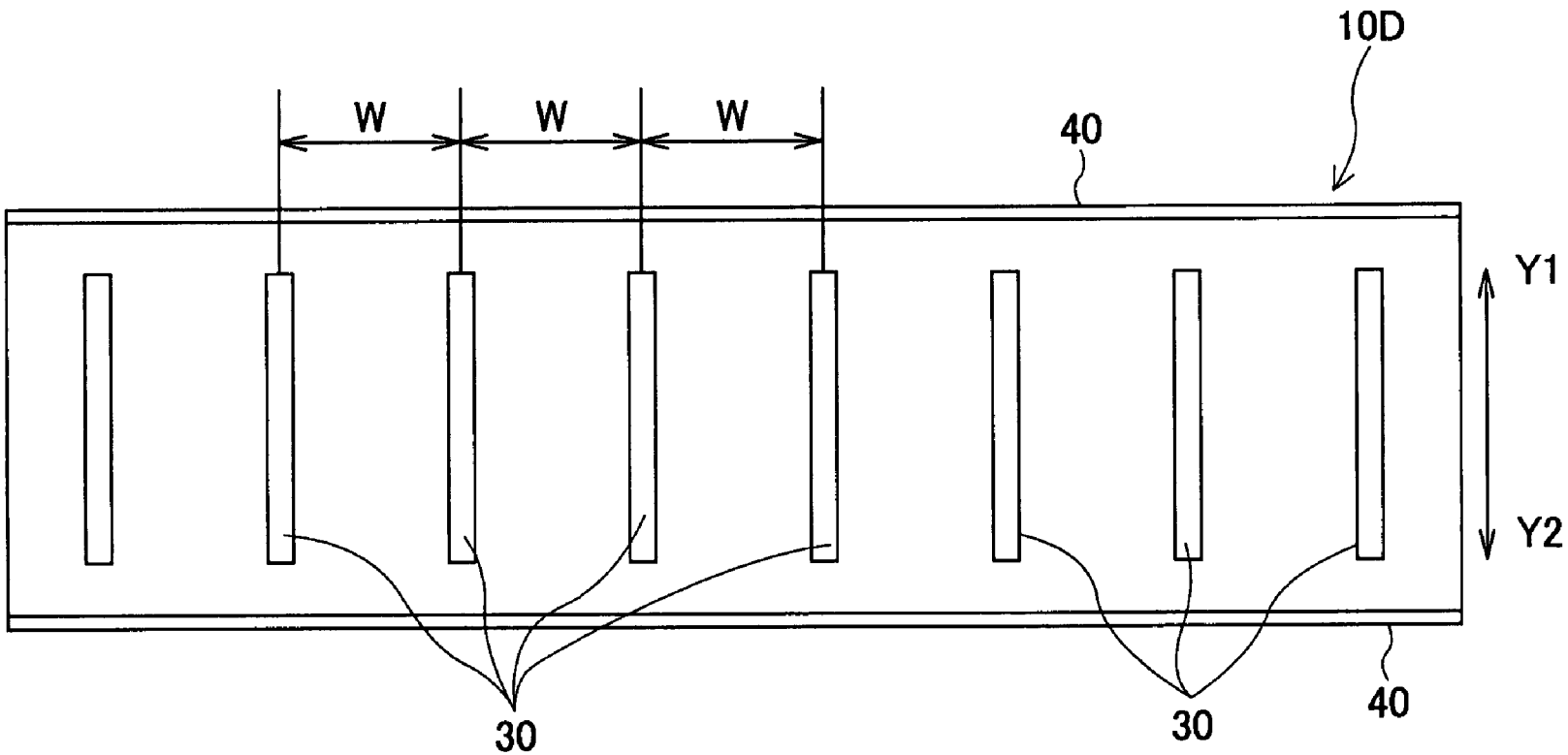
FIG.2 PRIOR ART
FIG. 2 is a developed view of the inner sidewall of an airtight tube forming the discharge tube of FIG. 1.
Figure 3:
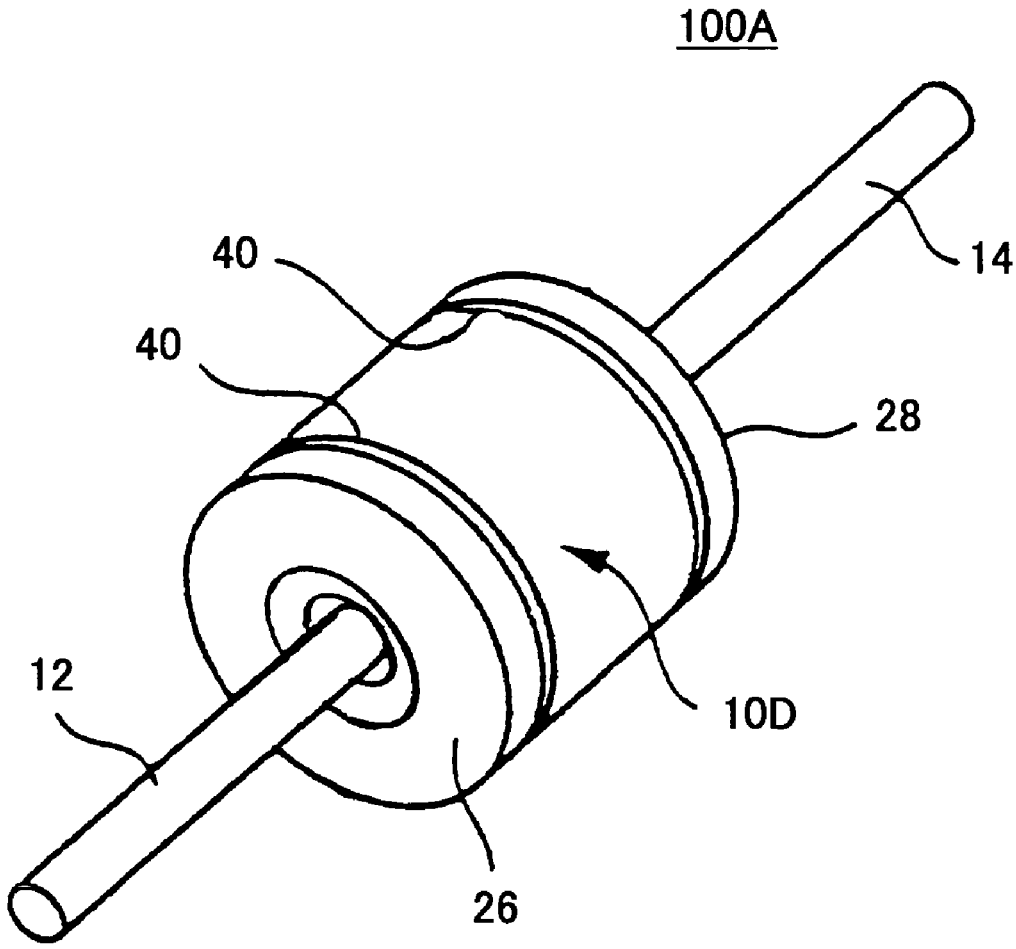
FIG.3 PRIOR ART
FIG. 3 is a perspective view of the discharge tube of FIG. 1.
Figure 4:
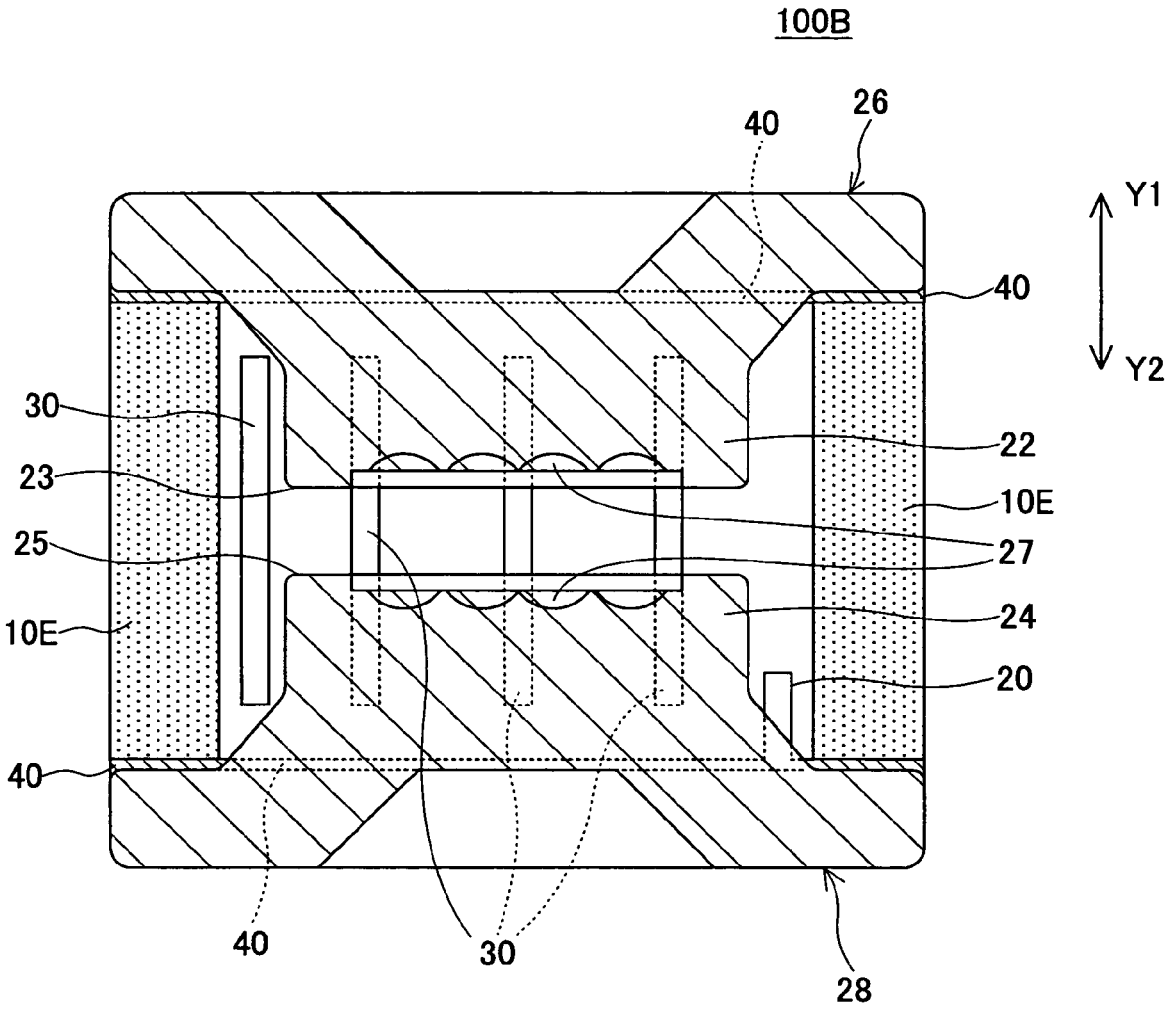
FIG.4 PRIOR ART
FIG. 4 is a cross-sectional view of a second conventional discharge tube.
Figure 8:
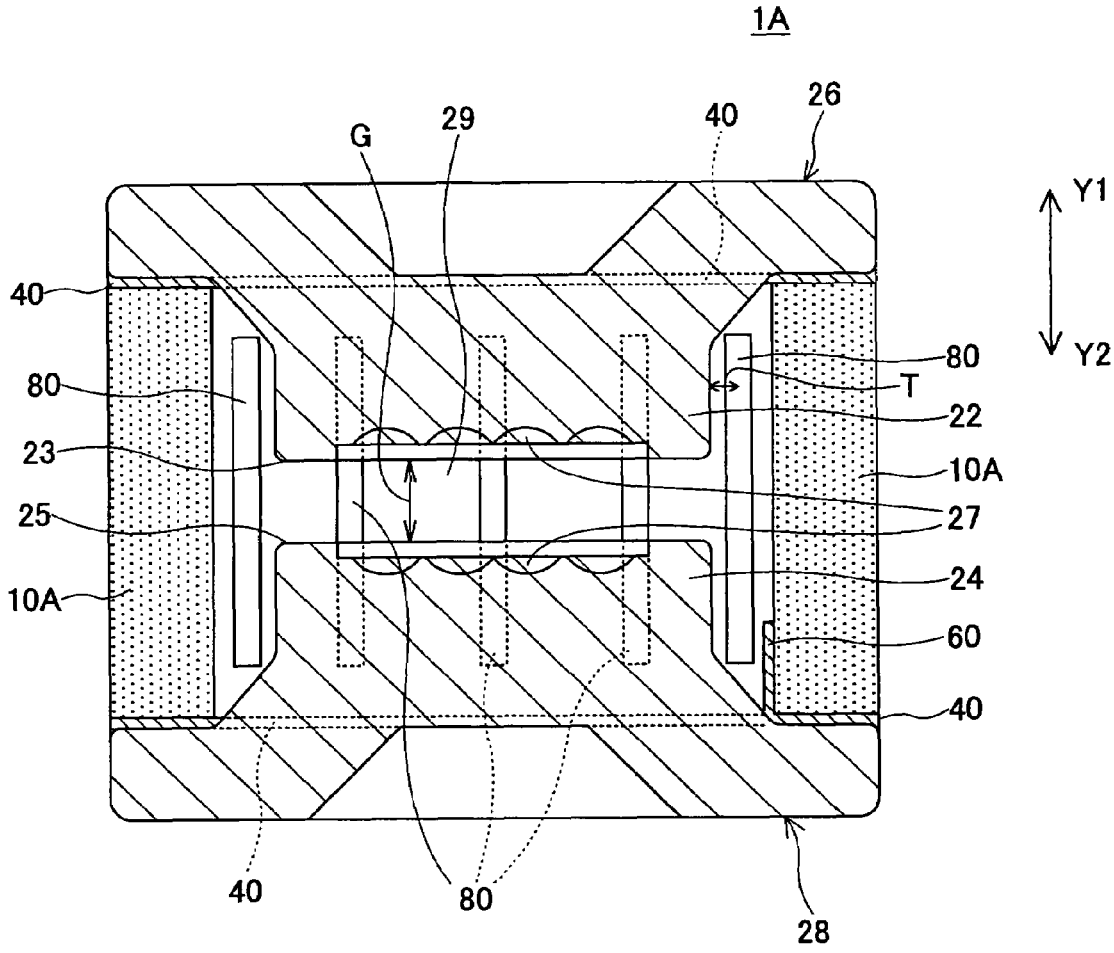
FIG. 8 is a cross-sectional view of a discharge tube 1A according to a first embodiment of the present invention.
Figure 9:
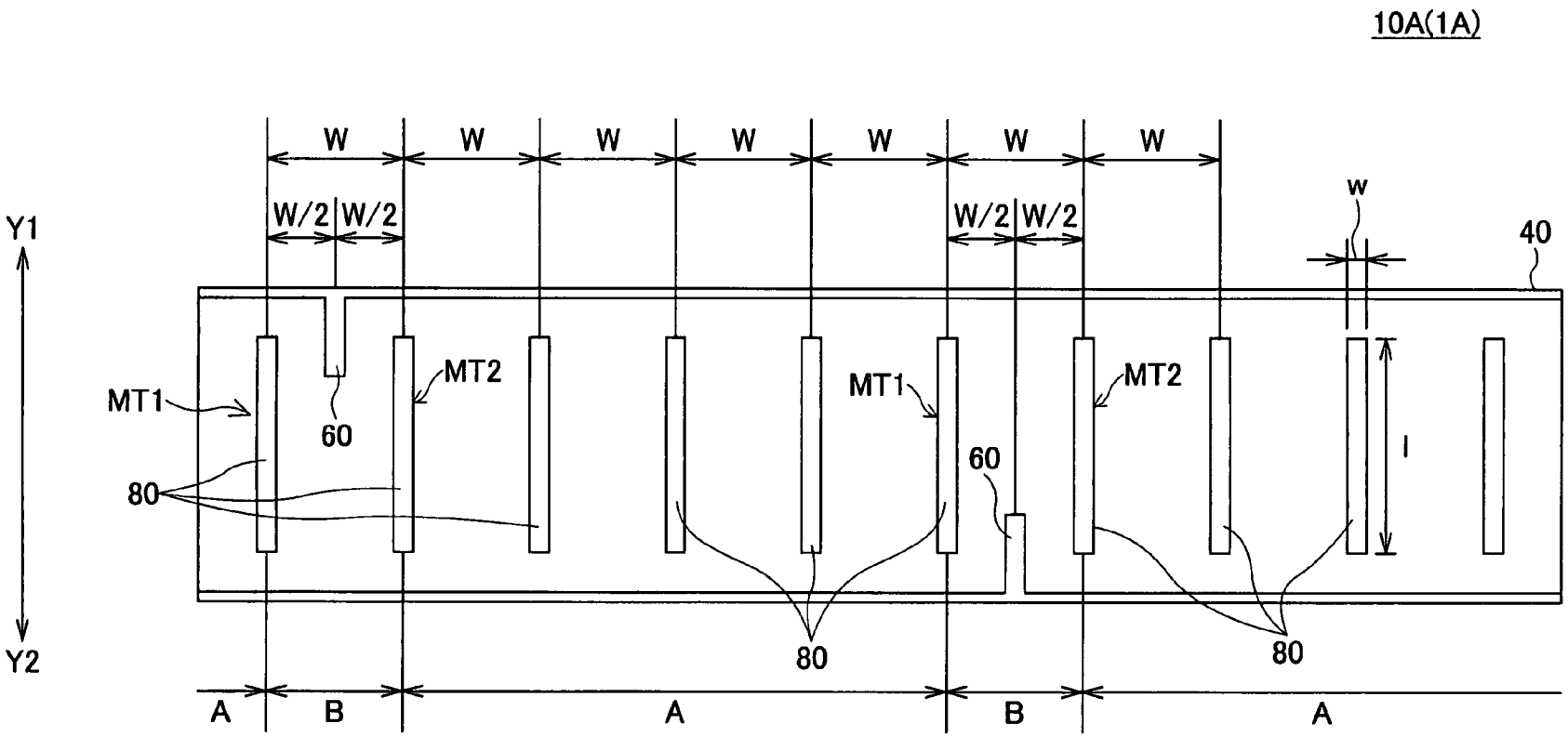
FIG. 9 is a developed view of the inner sidewall of an airtight tube of the discharge tube according to the first embodiment of the present invention.

FIG. 8 is a cross-sectional view of a discharge tube 1A according to a first embodiment of the present invention. FIG. 9 is a developed view (cylindrical surface straightened into a rectangle) of the inner sidewall of an airtight tube 10A of the discharge tube 1A. In this embodiment, the same elements as those described above with reference to FIGS. 1 through 3 are referred to by the same numerals.

Referring to FIG. 8, the discharge tube 1A includes the airtight tube 10A (indicated by shading) and lid bodies 26 and 28. The outside dimensions of the discharge tube 1A are defined so that the discharge tube 1A is, for instance, 8.0 mm in outside diameter and 6.0 mm in length.

The airtight tube 10A is shaped like a cylinder and formed of an insulator such as a ceramic. The outside dimensions of the airtight tube 10A are defined so that the airtight tube 10A is, for instance, 8.0 mm in outside diameter, 6.0 mm in inside diameter, and 4.7 mm in length. Further, the metallized surfaces 40 are formed at the upper-end opening and the lower-end opening of the airtight tube 10A.

Each of the lid bodies 26 and 28 is formed of metal such as 42 alloy (an iron-nickel alloy), and has a substantially disk shape. The upper discharge electrode 22 is integrated with the lid body 26, and the lower discharge electrode 24 is integrated with the lid body 28. The lid bodies 26 and 28 are joined to the upper-end opening and the lower-end opening, respectively, of the airtight tube 10A. Specifically, the lid bodies 26 and 28 are joined to the airtight tube 10A by being brazed to the corresponding metallized surfaces 40.

This joining is performed so that the upper discharge electrode 22 and the lower discharge electrode 24 oppose each other in the airtight tube 10A. Further, at the time of this joining, the airtight tube 10A is filled with a gas mixture of inert gas. Accordingly, the gas mixture filling the airtight tube 10A is hermetically sealed in the airtight tube 10A by joining the lid bodies 26 and 28 to the airtight tube 10A.

With the lid member 26 being joined to the airtight tube 10A, the upper discharge electrode 22 projects from the lid member 26 toward the center position of the airtight tube 10A. Further, the upper discharge surface 23 is formed on the end portion of the upper discharge electrode 22. The upper discharge surface 23 includes the recess 27 for causing discharge to occur in a stabilized manner.

Likewise, with the lid member 28 being joined to the airtight tube 10A, the lower discharge electrode 24 projects from the lid member 28 toward the center position of the airtight tube 10A. Further, the lower discharge surface 25 is formed on the end portion of the lower discharge electrode 24. The lower discharge surface 25 includes the recess 27 for causing discharge to occur in a stabilized manner.

In the discharge tube 1A, discharges occur in the discharge gap 29, which is the space between the upper discharge surface 23 and the lower discharge surface 25.

According to this embodiment, the recess 27 formed on each of the upper discharge surface 23 and the lower discharge surface 25 includes irregularities in order to increase the area of each of the discharge surfaces 23 and 25 so that the discharge (service) life of the discharge tube 1A is prolonged. That is, since the discharge life of a discharge tube is proportional to the area of a discharge surface, the discharge life of the discharge tube 1A can be prolonged by increasing the area of each of the discharge surfaces 23 and 25 by providing irregularities thereto.

Referring to FIGS. 8 and 9, in the discharge tube 1A of the above-described structure, two sub discharge trigger wires 60 (first trigger lines) and ten main discharge trigger wires 80 (second trigger lines) are formed on the inner sidewall (inner wall surface) of the airtight tube 10A. Both the main discharge trigger wires 80 and the sub discharge trigger wires 60 are formed (to extend) along the axial directions of the airtight tube 10A (or the Y1 and Y2 directions of FIGS. 8 and 9).

Each main discharge trigger wire 80 is made of a conductive material such as carbon, and is defined to be approximately 0.5 mm in line width w (FIG. 9) and approximately 2.5–3.5 mm in length l (FIG. 9). The main discharge trigger wires 80 are spaced from the metallized surfaces 40 so as to be electrically isolated from the metallized surfaces 40.

Each sub discharge trigger wire 60 is made of a conductive material such as carbon, and is set to be approximately 0.5 mm in line width but shorter in length than the main discharge trigger wires 80. One of the upper end and the lower end of each sub discharge trigger wire 60 is electrically connected to the metallized surface 40 formed on the upper-end or lower-end surface of the airtight tube 10A.

Further, referring to FIG. 8, according to this embodiment, the discharge tube 1A is configured so that the relationship between the interval T between each of the discharge electrodes 22 and 24 and each main discharge trigger wire 80 and the gap length G of the discharge gap 29 satisfies $G \leqq T$. According to this configuration, a life characteristic can be improved, and the initial discharge starting voltage $FV_s$ and the mean discharge voltage $V_{s\ MEAN}$ can be stabilized.

A description is given below, with reference to FIG. 9, of the configuration of the discharge tube 1A, focusing on the state of disposition (arrangement) of the sub discharge trigger wires 60 and the main discharge trigger wires 80 formed on the airtight tube 10A according to this embodiment.

The ten main discharge trigger wires 80 are formed at equal intervals (with the same pitch W). That is, the interval between each pair of the adjacent main discharge trigger wires 80 is the regular interval W. On the other hand, the sub discharge trigger wires 60 are formed 180° apart from each other. Accordingly, five of the main discharge trigger wires 80 are provided in each of the two spaces between the pair of the sub discharge trigger wires 60.

Figure 5:
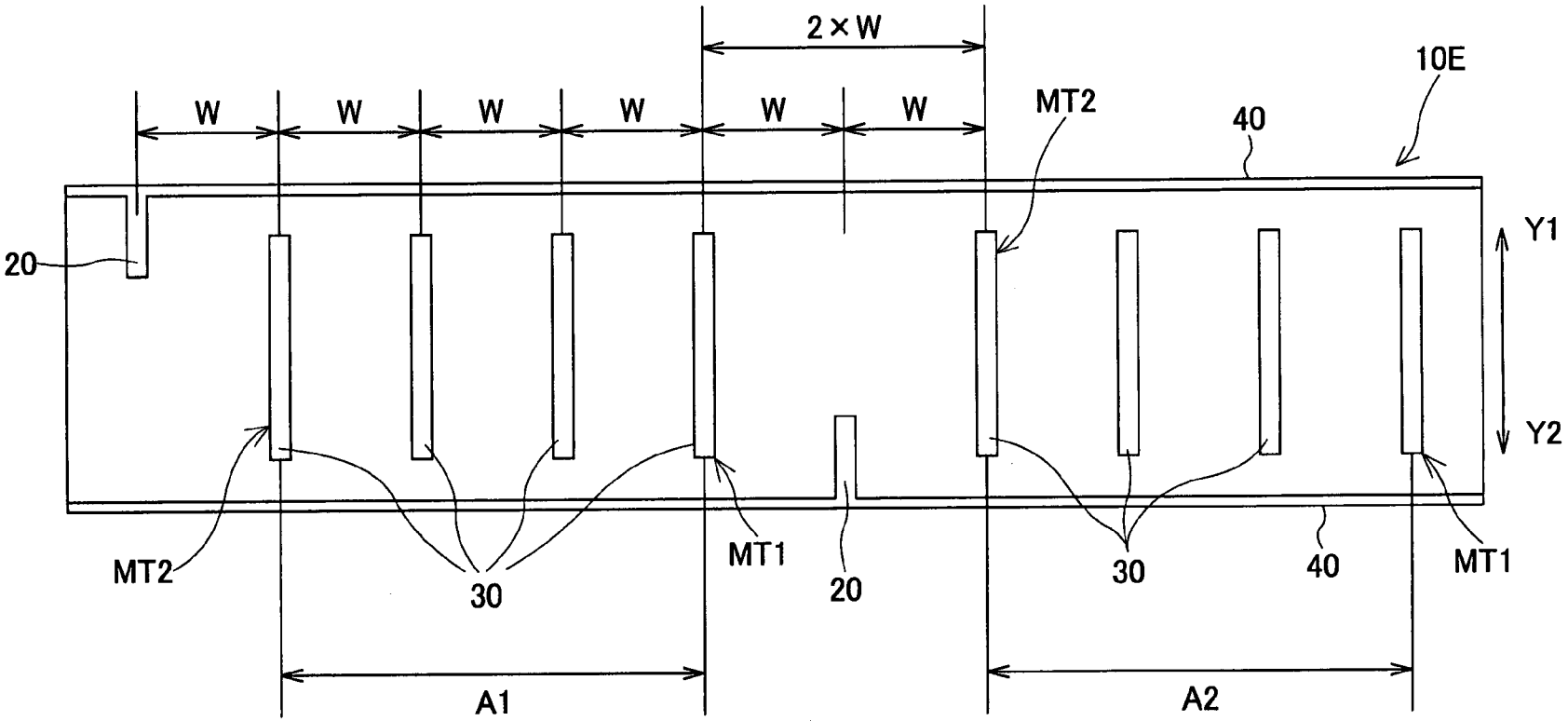
FIG.5 PRIOR ART
FIG. 5 is a developed view of the inner sidewall of an airtight tube forming the discharge tube of FIG. 4.

Referring back to FIG. 5, the second conventional discharge tube 100B is configured so that the interval between each sub discharge trigger wire 20 and each of its adjacent main discharge trigger wires 30 (indicated by MT1 and MT2) is also W. Accordingly, the interval between each pair of adjacent trigger wires is W irrespective of whether the adjacent trigger wires are the main discharge trigger wires 30 or a combination of the sub discharge trigger wire 20 and the main discharge trigger wire 30.

On the other hand, referring to FIG. 9, according to the discharge tube 1A of this embodiment, the ten main discharge trigger wires 80 are spaced at the same interval W. Each sub discharge trigger wire 60 is disposed between a corresponding pair of the main discharge trigger wires 80 (indicated by arrows MT1 and MT2) spaced at this regular interval W.

In particular, according to this embodiment, each sub discharge trigger wire 60 is positioned in the center between the paired main discharge trigger wires 80 (indicated by arrows MT1 and MT2). Accordingly, the interval between each sub discharge trigger wire 60 and the corresponding main discharge trigger wire 80 indicated by arrow MT1 is W/2 and the interval between each sub discharge trigger wire 60 and the corresponding main discharge trigger wire 80 indicated by arrow MT2 is also W/2.

Accordingly, equal interval parts and unequal interval parts are formed in the overall trigger wire arrangement of the sub discharge trigger wires 60 and the main discharge trigger wires 80. That is, the equal interval parts where the main discharge trigger wires 80 are equally spaced side by side at the same interval (regular intervals) W (each region indicated by arrow A in FIG. 9) and the unequal interval parts where the sub discharge trigger wires 60 are formed so that each sub discharge trigger wire 60 and each of its adjacent main discharge trigger wires 80 are disposed side by side at an interval different from the interval W (W/2 in this embodiment) (each region indicated by arrow B in FIG. 9) are formed (on the inner sidewall of the airtight tube 10A).

Figure 10:
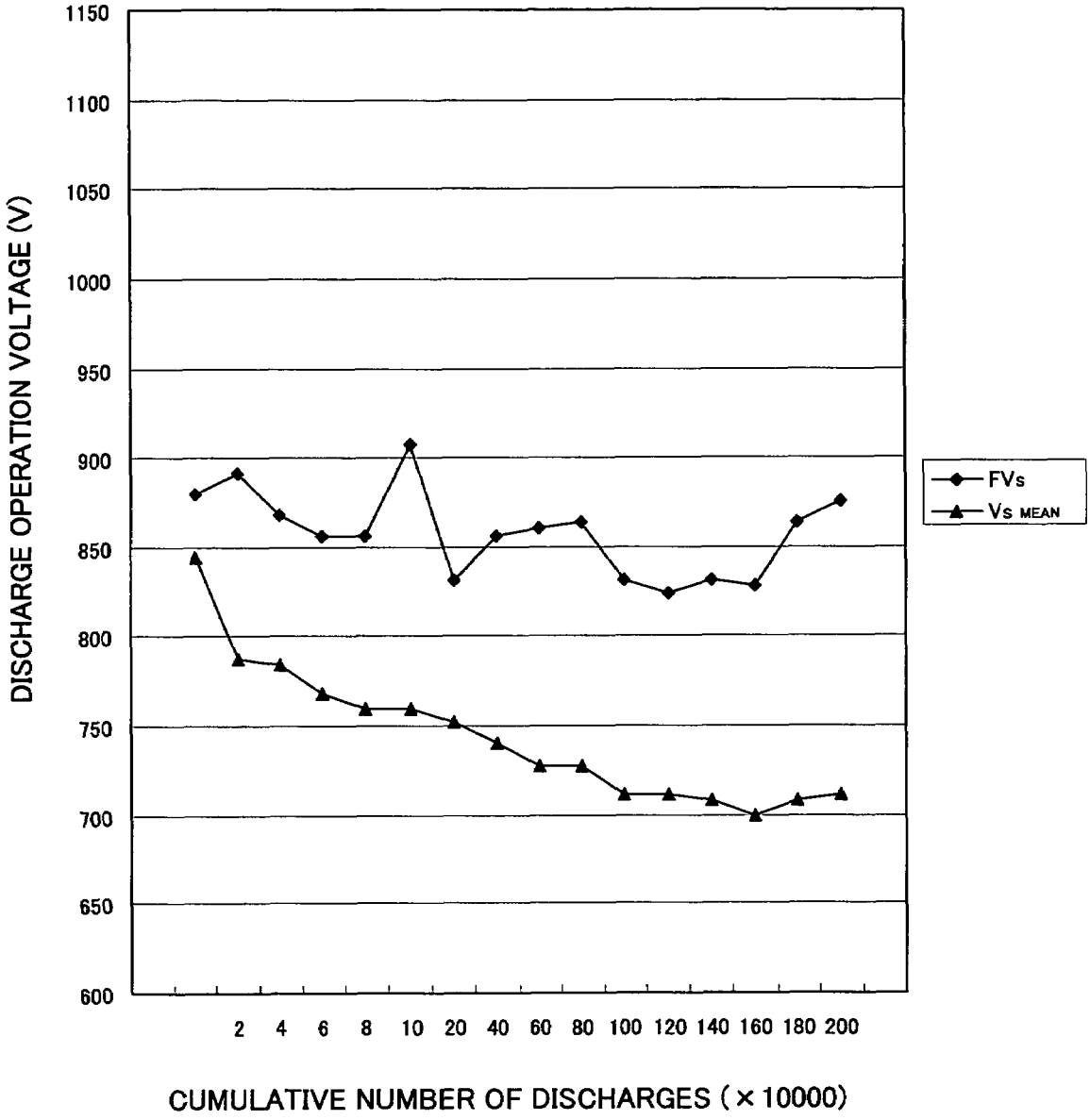
FIG. 10 is a graph of discharge characteristic data showing the results of a discharge life test on the discharge tube according to the first embodiment of the present invention.

FIG. 10 is a graph showing the results of a discharge (service) life test conducted to obtain changes over time in the initial discharge starting voltage $FV_s$ (the discharge starting voltage of an initial discharge) and the mean discharge voltage $V_{s\ MEAN}$ (the mean discharge voltage of second and subsequent discharges) in the discharge tube 1A of the above-described configuration. In FIG. 10, the horizontal axis indicates the cumulative number of discharges (×10,000), and the vertical axis indicates discharge operation voltage (V).

Figure 6:
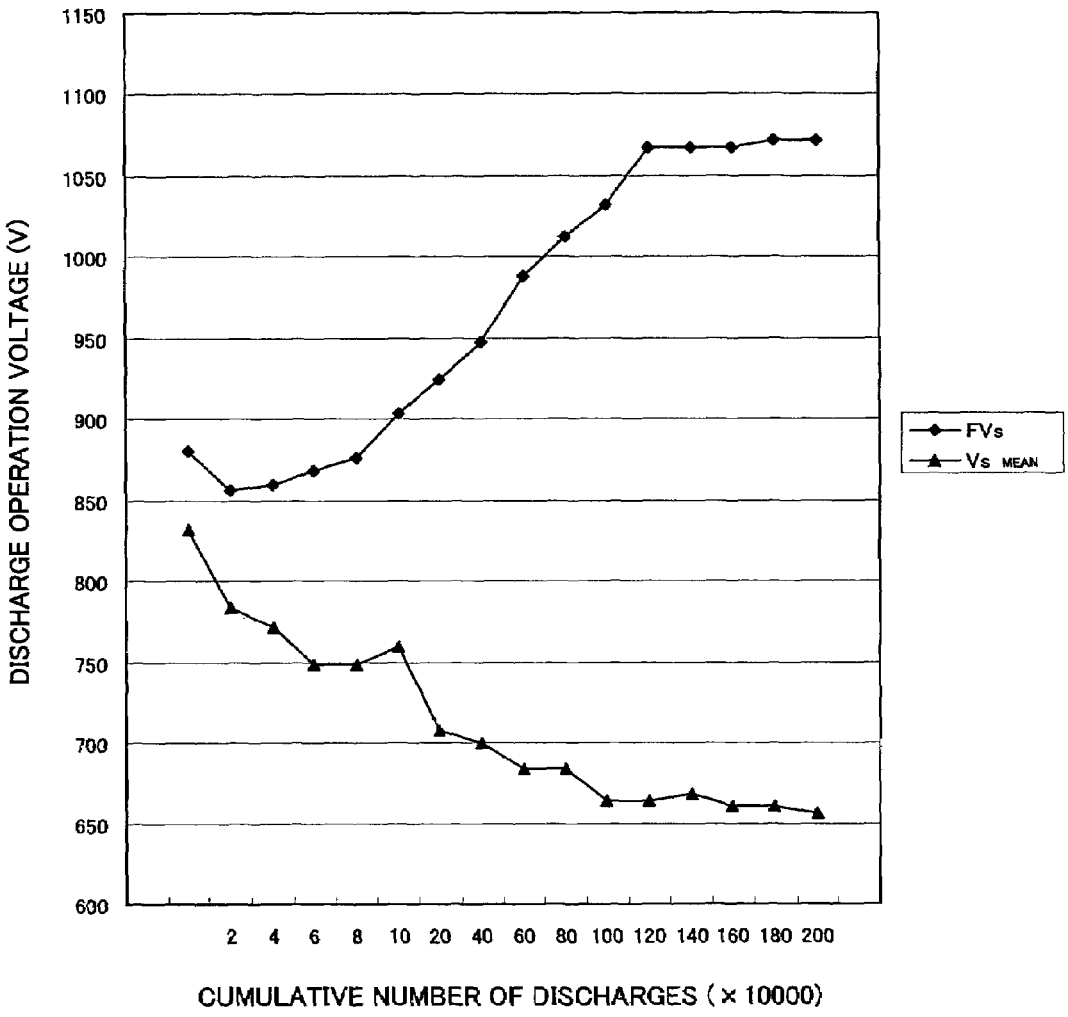
FIG.6 PRIOR ART
FIG. 6 is a graph of discharge characteristic data showing the results of a discharge life test on the first conventional discharge tube.
Figure 7:
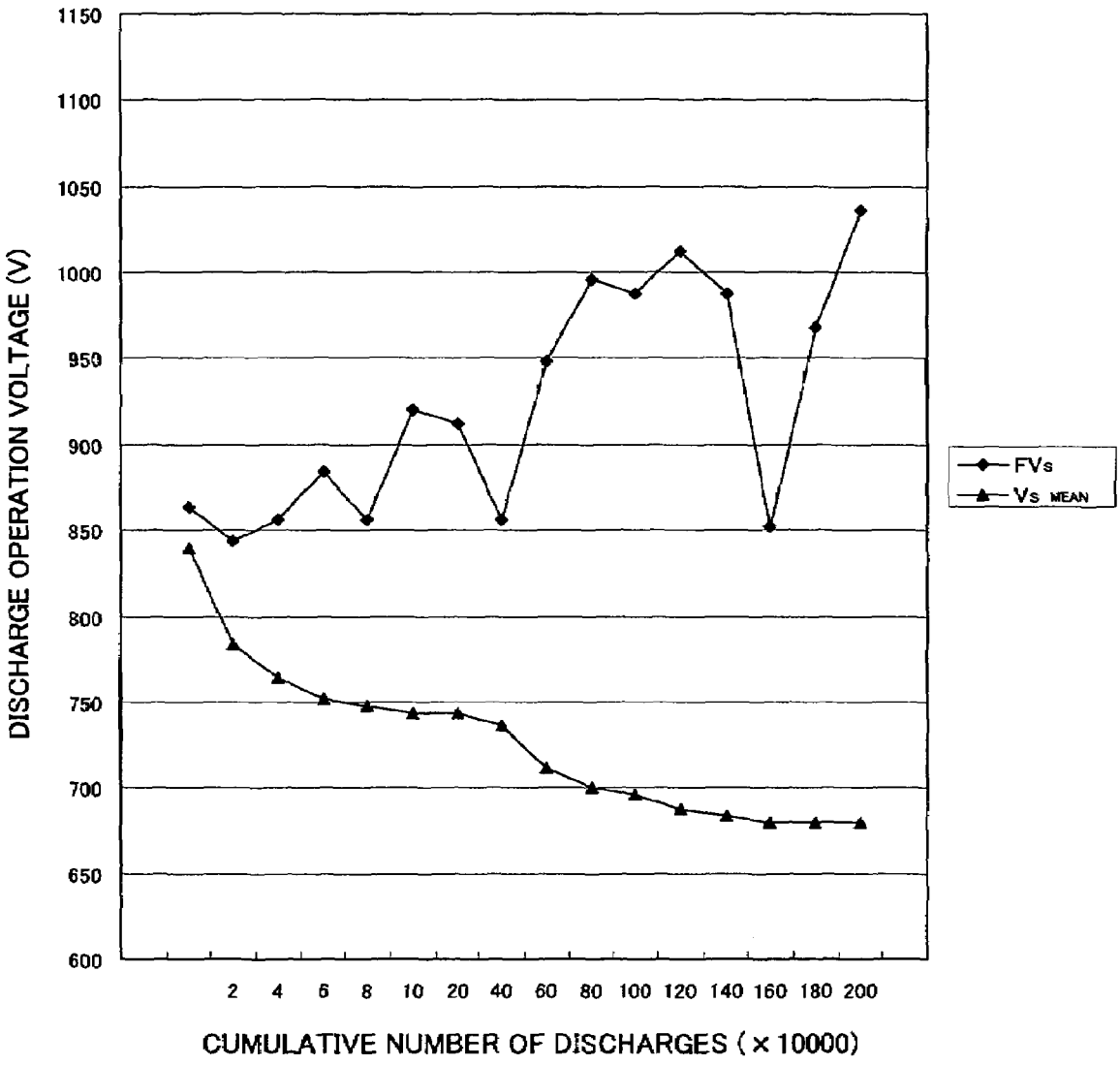
FIG.7 PRIOR ART
FIG. 7 is a graph of discharge characteristic data showing the results of the discharge life test on the second conventional discharge tube.

In this test, the initial discharge starting voltage $FV_s$ and the mean discharge voltage $V_{s\ MEAN}$ at the time of causing the discharge tube 1A to perform discharging after the discharge tube 1A was left in a completely dark place at −40° C. (dark cold environment) for a predetermined period of time were also studied at each predetermined point as in the discharge life tests described with reference to FIGS. 6 and 7. As described above, this discharge life test conducted in the dark cold environment, which is free of the effect of thermoelectrons and the effect of photoelectrons, is the severest one of the discharge life tests. Specific test conditions are equal to the above-described conditions (a) through (c), and a description thereof is omitted.

FIG. 10 shows that in the discharge tube 1A, an increase in the cumulative number of discharges is accompanied by neither a rise nor a great fluctuation in the initial discharge starting voltage $FV_s$. Such a good characteristic can be obtained because the main discharge trigger wires 80 are equally spaced at the same interval W so that main discharge in the discharge gap 29 is likely to be induced and because formation of the sub discharge trigger wires 60 makes it easier for the main discharge to be transferred after the occurrence of surface corona discharge.

As described above, the initial discharge starting voltage $FV_s$ is stable in the discharge tube 1A according to this embodiment. Accordingly, in the case of employing the discharge tube 1A in an HID lamp lighting circuit, a stable circuit operation can be realized. Further, there is no rise over time in the initial discharge starting voltage $FV_s$, which enables the discharge tube 1A to have a longer useful service life.

Figure 11:
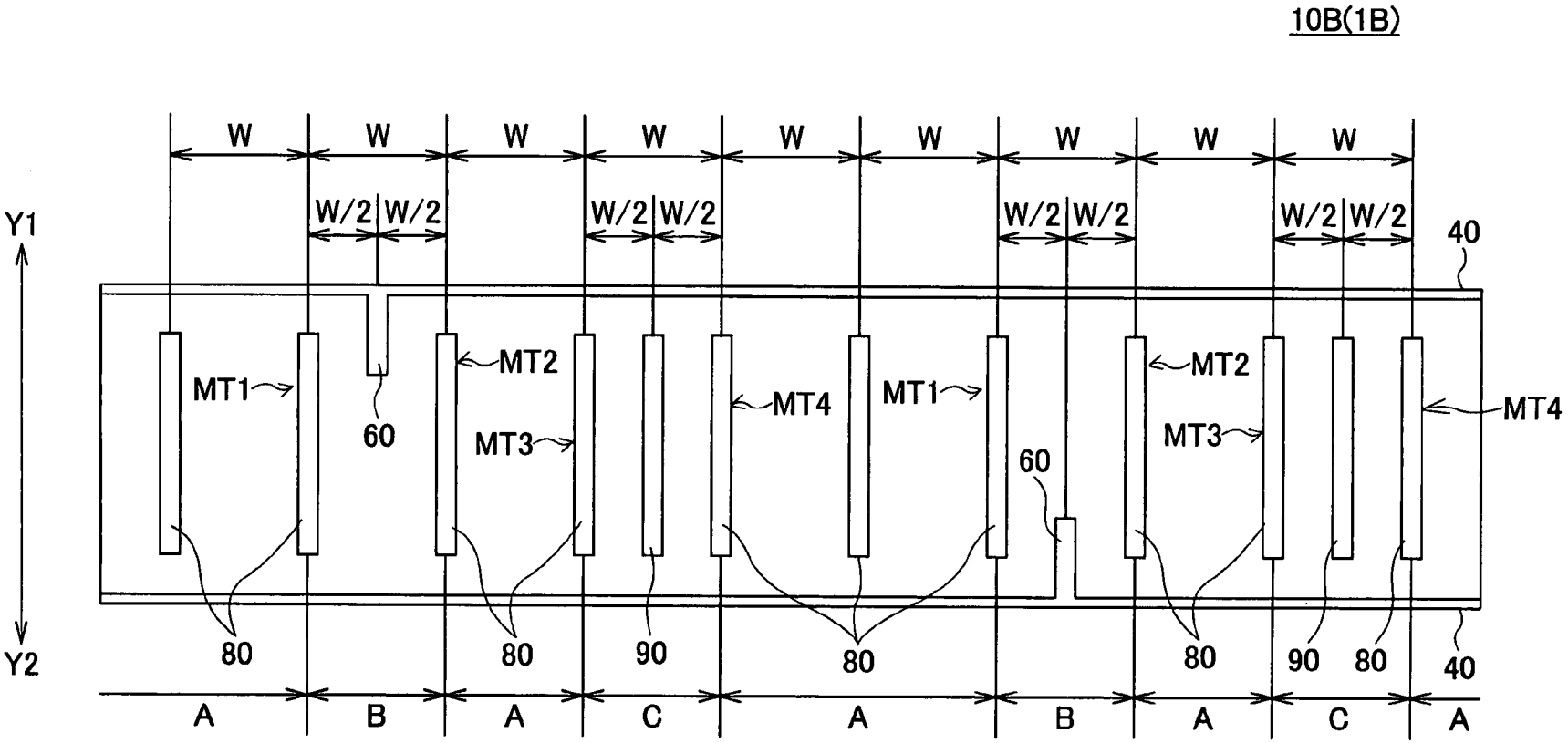
FIG. 11 is a developed view of the inner sidewall of an airtight tube of a discharge tube according to a second embodiment of the present invention.

Next, a description is given of a second embodiment of the present invention. FIG. 11 shows the developed state of an airtight tube 10B forming a discharge tube 1B according to the second embodiment of the present invention. In FIG. 11, the same elements as those shown in FIGS. 8 and 9 used for the description of the first embodiment are referred to by the same numerals, and a description thereof is omitted.

Compared with the discharge tube 1A according to the first embodiment, the discharge tube 1B according to this embodiment is characterized by further including interposition discharge trigger wires 90 (third trigger lines) each formed between a corresponding pair of the main discharge trigger wires 80. Like the main discharge trigger wires 80 and the sub discharge trigger wires 60, the interposition discharge trigger wires 90 are made of a conductive material such as carbon, and are formed (to extend) along the axial directions of the airtight tube 10B (or the Y1 and Y2 directions of FIG. 11). In this embodiment, the interposition discharge trigger wires 90 are equal in shape to the main discharge trigger wires 80. Alternatively, the interposition discharge trigger wires 90 may be different in shape from the main discharge trigger wires 80.

A description is given below of the state of disposition (arrangement) of the sub discharge trigger wires 60, the main discharge trigger wires 80, and the interposition discharge trigger wires 90 formed on the airtight tube 10B according to this embodiment.

First, the ten main discharge trigger wires 80 are also formed at regular intervals (with the same pitch W) in this embodiment. The sub discharge trigger wires 60 are formed 180° apart from each other. Accordingly, five of the main discharge trigger wires 80 are provided in each space between the pair of the sub discharge trigger wires 60. Further, each sub discharge trigger wire 60 is disposed between a corresponding pair of the main discharge trigger wires 80 (indicated by arrows MT1 and MT2 in FIG. 11) spaced at this regular interval W. The above-described configuration is equal to that of the discharge tube 1A according to the first embodiment.

This embodiment is characterized in that each interposition discharge trigger wire 90 is further disposed between a corresponding pair of the main discharge trigger wires 80 (indicated by arrows MT3 and MT4) spaced at this regular interval W.

In particular, according to this embodiment, each interposition discharge trigger wire 90 is positioned in the center between the paired main discharge trigger wires 80 (indicated by arrows MT3 and MT4). Accordingly, the interval between each interposition discharge trigger wire 90 and the corresponding main discharge trigger wire 80 indicated by arrow MT3 is W/2 and the interval between each interposition discharge trigger wire 90 and the corresponding main discharge trigger wire 80 indicated by arrow MT4 is also W/2.

Accordingly, in the discharge tube 1B according to this embodiment, equal interval parts and unequal interval parts are also formed in the arrangement of the sub discharge trigger wires 60, the main discharge trigger wires 80, and the interposition discharge trigger wires 90. That is, the equal interval parts where the main discharge trigger wires 80 are equally spaced side by side at the same interval (regular intervals) W (each region indicated by arrow A in FIG. 11), first unequal interval parts where the sub discharge trigger wires 60 are formed so that each sub discharge trigger wire 60 and each of its adjacent main discharge trigger wires 80 are disposed side by side at an interval (W/2) different from the interval W (each region indicated by arrow B in FIG. 11), and second unequal interval parts where the interposition discharge trigger wires 90 are formed so that the interposition discharge trigger wire 90 and each of its adjacent main discharge trigger wires 80 are disposed side by side at the interval (W/2) different from the interval W (each region indicated by arrow C in FIG. 11), are formed (on the inner sidewall of the airtight tube 10B).

Figure 12:
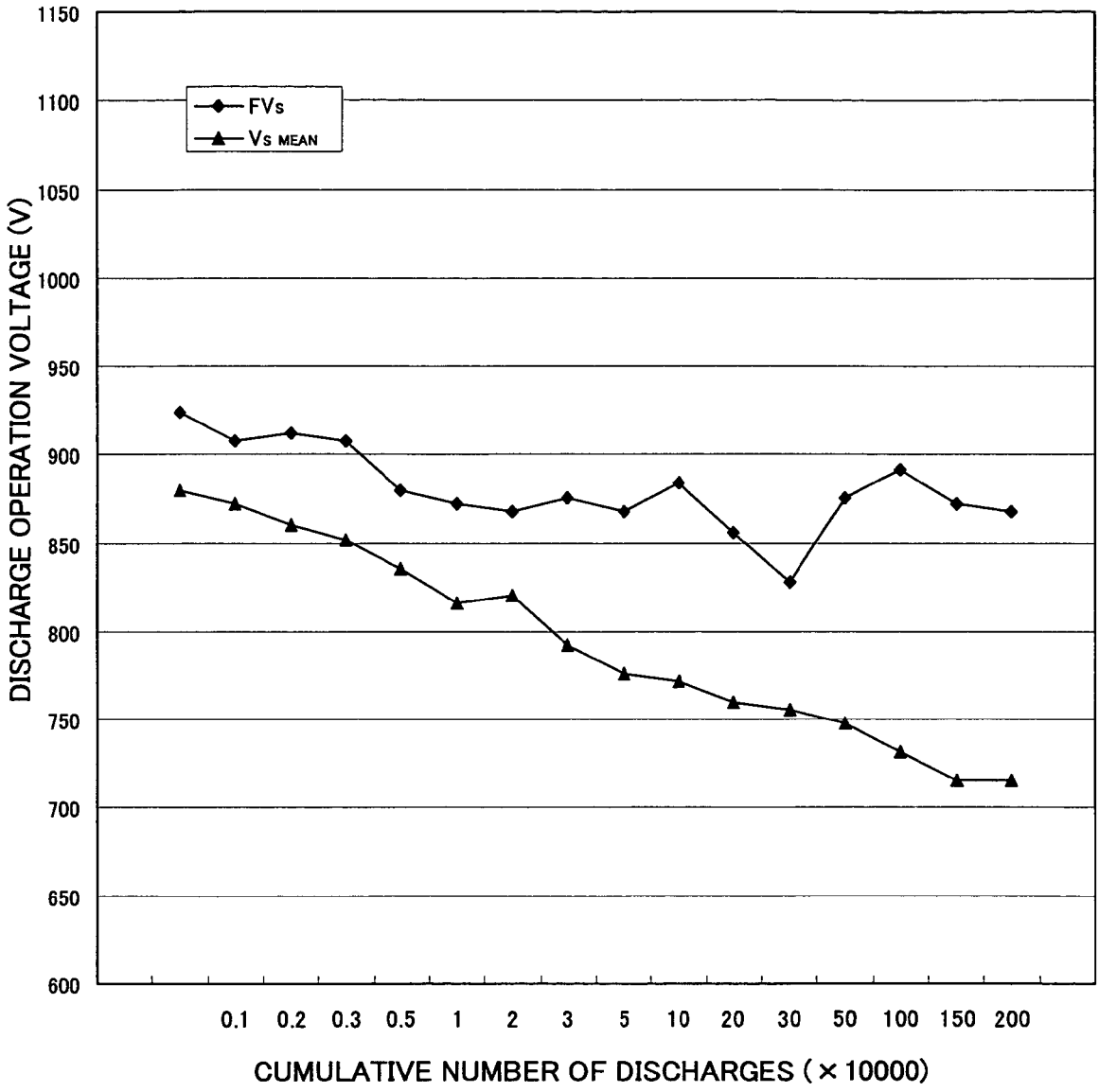
FIG. 12 is a graph of discharge characteristic data showing the results of a discharge life test on the discharge tube according to the second embodiment of the present invention.

FIG. 12 is a graph showing the results of a discharge (service) life test conducted to obtain changes over time in the initial discharge starting voltage $FV_s$ and the mean discharge voltage $V_{s\ MEAN}$ in the discharge tube 1B of the above-described configuration. In FIG. 12, the horizontal axis indicates the cumulative number of discharges (×10,000), and the vertical axis indicates discharge operation voltage (V).

In this test, the initial discharge starting voltage $FV_s$ and the mean discharge voltage $V_{s\ MEAN}$ at the time of causing the discharge tube 1B to perform discharging after the discharge tube 1B was left in a completely dark place at −40° C. (dark cold environment) for a predetermined period of time were also studied at each predetermined point as in the discharge life tests described with reference to FIGS. 6 and 7. Specific test conditions are equal to the above-described conditions (a) through (c).

FIG. 12 shows that like in the discharge tube 1A shown in FIG. 10, an increase in the cumulative number of discharges is accompanied by neither a rise nor a great fluctuation in the initial discharge starting voltage $FV_s$ in the discharge tube 1B. Accordingly, a stable discharge operation can also be realized by the discharge tube 1B according to this embodiment. Further, there is no rise over time in the initial discharge starting voltage $FV_s$, either, which enables the discharge tube 1B to have a longer useful service life.

Figure 13:
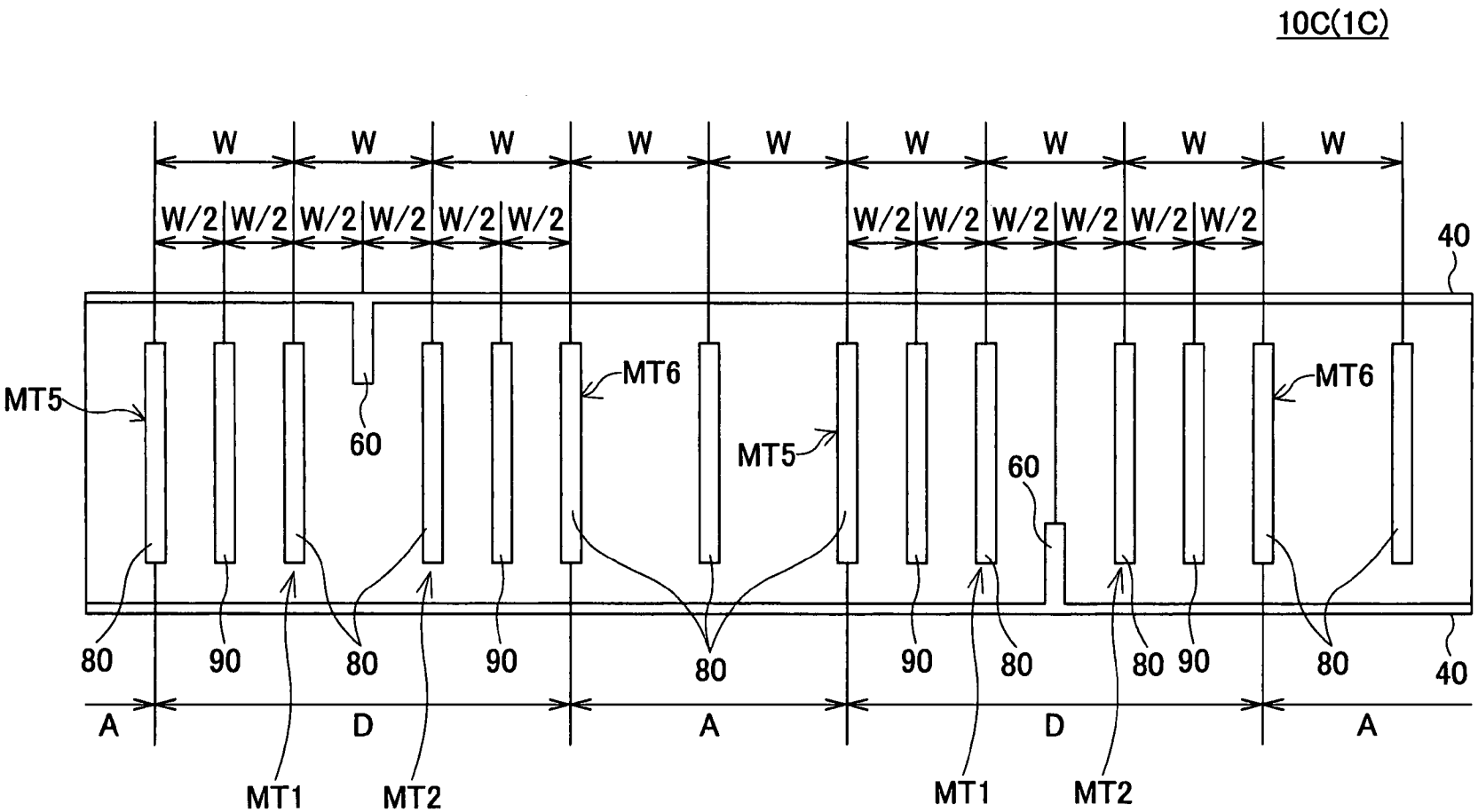
FIG. 13 is a developed view of the inner sidewall of an airtight tube of a discharge tube according to a third embodiment of the present invention.

Next, a description is given of a third embodiment of the present invention. FIG. 13 shows the developed state of an airtight tube 10C forming a discharge tube 1C according to the third embodiment of the present invention. In FIG. 13, the same elements as those shown in FIGS. 8, 9, and 11 used for the description of the first and second embodiments are referred to by the same numerals, and a description thereof is omitted.

Like the above-described discharge tube 1B according to the second embodiment, the discharge tube 1C according to this embodiment is characterized by including the interposition discharge trigger wires 90 each formed between a corresponding pair of the main discharge trigger wires 80. The configuration of each interposition discharge trigger wire 90 is equal to that described in the second embodiment.

A description is given below of the state of disposition (arrangement) of the sub discharge trigger wires 60, the main discharge trigger wires 80, and the interposition discharge trigger wires 90 formed on the airtight tube 10C according to this embodiment.

In this embodiment, the main discharge trigger wires 80 are also formed at regular intervals (with the same pitch W). The sub discharge trigger wires 60 are formed 180° apart from each other. Accordingly, five of the main discharge trigger wires 80 are provided in each space between the pair of the sub discharge trigger wires 60. Further, each sub discharge trigger wire 60 is disposed between a corresponding pair of the main discharge trigger wires 80 (indicated by arrows MT1 and MT2 in FIG. 13) spaced at this regular interval W. The above-described configuration is equal to those of the discharge tubes 1A and 1B according to the first and second embodiments, respectively.

This embodiment is characterized in that each interposition discharge trigger wire 90 is further disposed between a corresponding pair of the main discharge trigger wires 80 positioned close to each sub discharge trigger wire 60. Specifically, referring to FIG. 13, the interposition discharge trigger wires 90 are formed between each pair of the main discharge trigger wires 80 indicated by arrows MT1 and MT5 and each pair of the main discharge trigger wires 80 indicated by arrows MT2 and MT6.

Further, according to this embodiment, each interposition discharge trigger wire 90 is positioned at the center between a corresponding pair of the main discharge trigger wires 80 (MT1 and MT5 or MT2 and MT6). Accordingly, the interval between each interposition discharge trigger wire 90 and each of its adjacent main discharge trigger wires 80 (MT1 and MT5 or MT2 and MT6) is W/2.

Accordingly, in the discharge tube 1C according to this embodiment, equal interval parts and unequal interval parts are also formed in the arrangement of the sub discharge trigger wires 60, the main discharge trigger wires 80, and the interposition discharge trigger wires 90. That is, the equal interval parts where the main discharge trigger wires 80 are equally spaced side by side at the same interval (regular intervals) W (each region indicated by arrow A in FIG. 13) and the unequal interval parts where the sub discharge trigger wires 60 and the interposition discharge trigger wires 90 are formed so that the trigger wires 60, 80, and 90 are disposed side by side at an interval (W/2) different from the interval W (each region indicated by arrow D in FIG. 13) are formed (on the inner sidewall of the airtight tube 10C).

Figure 14:
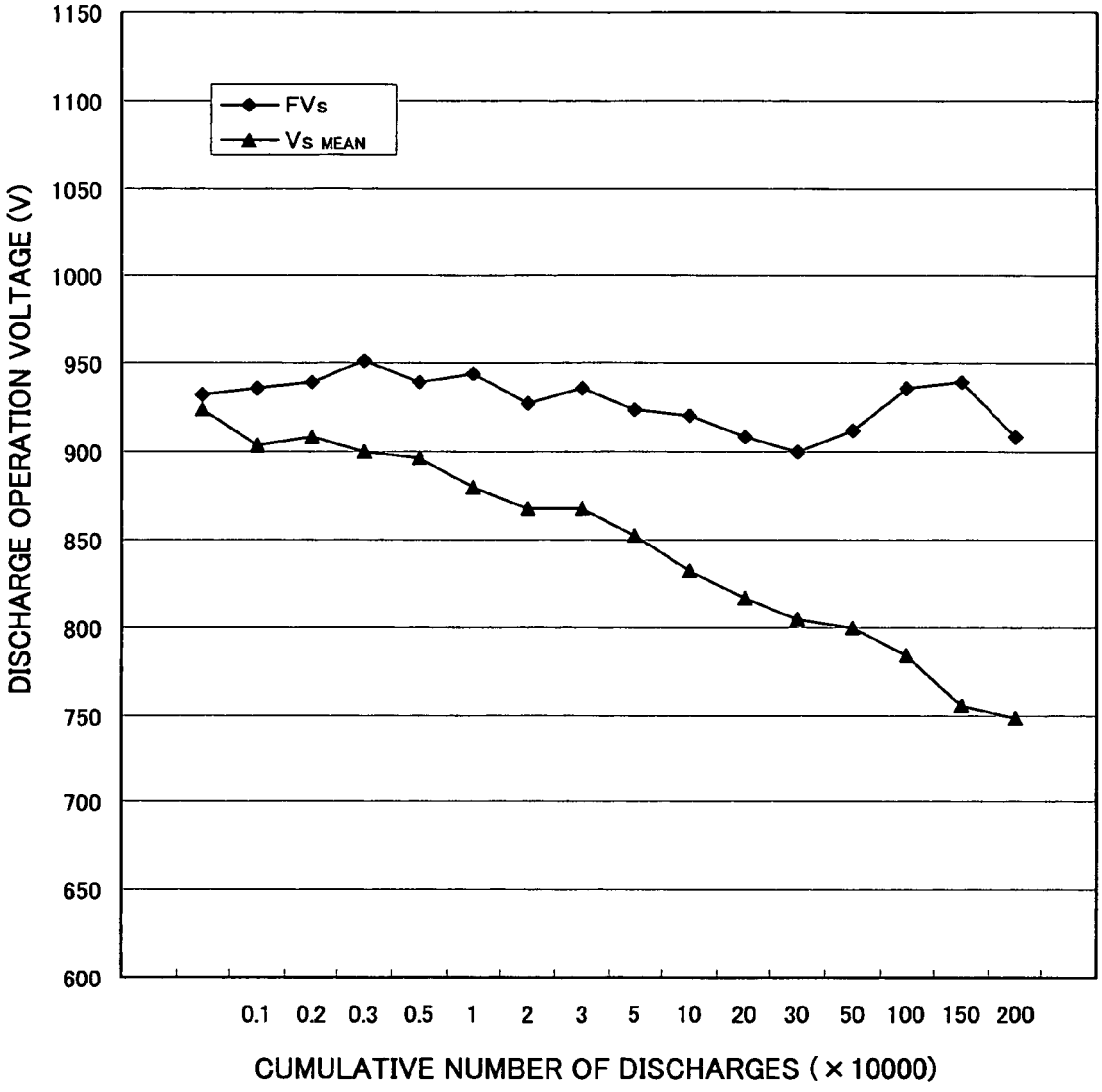
FIG. 14 is a graph of discharge characteristic data showing the results of a discharge life test on the discharge tube according to the third embodiment of the present invention.

FIG. 14 is a graph showing the results of a discharge (service) life test conducted to obtain changes over time in the initial discharge starting voltage $FV_s$ and the mean discharge voltage $V_{s\ MEAN}$ in the discharge tube 1C of the above-described configuration. In FIG. 14, the horizontal axis indicates the cumulative number of discharges (×10,000), and the vertical axis indicates discharge operation voltage (V).

In this test, the initial discharge starting voltage $FV_s$ and the mean discharge voltage $V_{s\ MEAN}$ at the time of causing the discharge tube 1C to perform discharging after the discharge tube 1C was left in a completely dark place at −40° C. (dark cold environment) for a predetermined period of time were also studied at each predetermined point as in the discharge life tests described with reference to FIGS. 6 and 7. Specific test conditions are equal to the above-described conditions (a) through (c).

FIG. 14 shows that like in the discharge tube 1A shown in FIG. 10, an increase in the cumulative number of discharges is accompanied by neither a rise nor a great fluctuation in the initial discharge starting voltage $FV_s$ in the discharge tube 1C. Accordingly, a stable discharge operation can also be realized by the discharge tube 1C according to this embodiment. Further, there is no rise over time in the initial discharge starting voltage $FV_s$, either, which enables the discharge tube 1C to have a longer useful service life.

Figure 15:
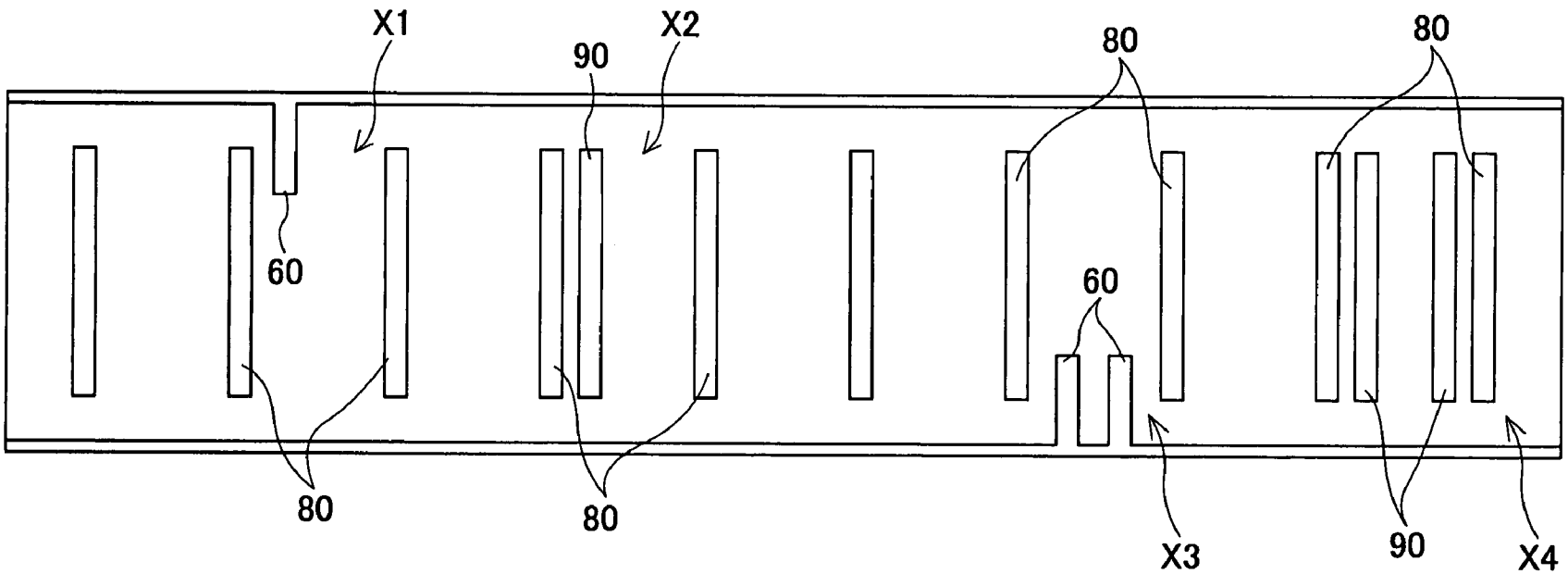
FIG. 15 is a developed view of the inner sidewall of an airtight tube of a discharge tube that is a variation of the discharge tubes of the first through third embodiments according to the present invention.

FIG. 15 shows a variation of the discharge tubes 1A through 1C according to the first through third embodiments. Each of the discharge tubes 1A through 1C is configured so that the main discharge trigger wires 80 are disposed at regular intervals (W) and each of the sub discharge trigger wires 60 and/or the interposition discharge trigger wires 90 is formed at the center position between a corresponding pair of the main discharge trigger wires 80.

However, each of the positions at which the sub discharge trigger wires 60 and the interposition discharge trigger wires 90 are formed, respectively, is not limited to the center position between the corresponding pair of the main discharge trigger wires 80. Referring to FIG. 15, the sub discharge trigger wire 60 and the interposition discharge trigger wire 90 may be formed at positions, indicated by arrows X1 and X2, each offset from the center position.

Further, the number of the sub discharge trigger wires 60 and the number of the interposition discharge trigger wires 90 are not limited to one, but may be more than one. In the configuration shown in FIG. 15, two sub discharge trigger wires 60 are formed between a corresponding pair of the main discharge trigger wires 80 as indicated by arrow X3 and two interposition discharge trigger wires 90 are formed between a corresponding pair of the main discharge trigger wires 80 as indicated by arrow X4.

Thus, according to the present invention, in a discharge tube, trigger wires, arranged with a first part where the trigger wires are arranged at a first interval and a second part where the trigger wires are arranged at a second interval different from the first interval, are formed in the arrangement. This configuration enables the discharge tube to have a longer useful service life and to stabilize discharge potentials repeatedly generated in the discharge tube.

The present invention is not limited to the specifically disclosed embodiments, and variations and modifications may be made without departing from the scope of the present invention.

The present application is based on Japanese Priority Patent Application No. 2003-347031, filed on Oct. 6, 2003, the entire contents of which are hereby incorporated by reference.

What is claimed is:

1. A discharge tube, comprising:

an airtight tube formed of an insulator, the airtight tube having an inner wall surface and first and second end surfaces having first and second metallized surfaces, respectively, formed thereon;

a first discharge electrode joined to the first metallized surface formed on the first end surface of the airtight tube;

a second discharge electrode joined to the second metallized surface formed on the second end surface of the airtight tube; and a plurality of trigger lines formed on the inner wall surface of the airtight tube so as to extend in axial directions of the airtight tube, wherein:

the first and second discharge electrodes are joined to the first and second metallized surfaces so that a discharge gap is formed between the first and second discharge electrodes and the airtight tube is hermetically sealed; and the trigger lines include at least one first trigger line connected to the first metallized surface and at least one second trigger line connected to the second metallized surface, the first and second trigger lines being separated from each other around the inner wall surface by a first distance, and a plurality of third trigger lines out of contact with and isolated from the first and second metallized surfaces, and each adjacent two of the third trigger lines are separated from each other around the inner wall surface by a same second distance that is different from the first distance.

2. The discharge tube as claimed in claim 1, wherein each of the at least one first trigger line and the at least one second trigger line is positioned between a corresponding pair of adjacent ones of the third trigger lines.

3. The discharge tube as claimed in claim 2, wherein each of the at least one first trigger line and the at least one second trigger line is positioned at a center between the corresponding pair of the adjacent ones of the third trigger lines.

4. The discharge tube as claimed in claim 1, wherein at least one of the third trigger lines is positioned at a center between a corresponding pair of adjacent ones of the first and second trigger lines.

5. The discharge tube as claimed in claim 1, wherein two or more of the third trigger lines are formed between the at least one first trigger line and the at least one second trigger lines.

6. The discharge tube as claimed in claim 1, wherein each of the at least one first trigger line and the at least one second trigger line is formed between a corresponding pair of adjacent ones of the third trigger lines so that each of the at least one first trigger line and the at least one second trigger line and the corresponding pair of the adjacent ones of the third trigger lines are spaced from each other by a second distance that is a half of the first distance.

7. The discharge tube as claimed in claim 6, wherein:

two or more of the first trigger lines are formed between the corresponding pair of the adjacent ones of the third trigger lines.

8. The discharge tube as claimed in claim 6, wherein two or more of the second trigger lines are formed between the corresponding pair of the adjacent ones of the third trigger lines.

9. A discharge tube, comprising:

an airtight tube formed of an insulator, the airtight tube having an inner wall surface and first and second end surfaces having first and second metallized surfaces, respectively, formed thereon;

a first discharge electrode joined to the first metallized surface formed on the first end surface of the airtight tube;

a second discharge electrode joined to the second metallized surface formed on the second end surface of the airtight tube; and a plurality of trigger lines formed on the inner wall surface of the airtight tube so as to extend in axial directions of the airtight tube, wherein:

the first and second discharge electrodes are joined to the first and second metallized surfaces so that a discharge gap is formed between the first and second discharge electrodes and the airtight tube is hermetically sealed;

the trigger lines include a first trigger line connected to the first metallized surface and a second trigger line connected to the second metallized surface, the first and second trigger lines being separated from each other around the inner wall surface by a first distance greater than zero, and a plurality of third trigger lines out of contact with and isolated from the first and second metallized surfaces the third trigger lines are disposed so that each adjacent two of the third trigger lines are separated from each other around the inner wall surface by a second distance in a first region and a second region of the inner wall surface and are separated from each other around the inner wall surface by a third distance in a third region of the inner wall surface, the second and third distances being different from each other and from the first distance; and each of the first and second trigger lines is formed between a corresponding pair of adjacent ones of the third trigger lines in the second region of the inner wall surface so that each of the first and second trigger lines and the corresponding pair of the adjacent ones of the third trigger lines are separated from each other by the third distance, the first, second and third regions not overlapping one another.

10. The discharge tube as claimed in claim 9, wherein the second distance is twice the third distance.

* * * * *